United States Patent [19]

Herriott

[11] Patent Number: 4,748,834

[45] Date of Patent: Jun. 7, 1988

[54] KEY MADE OF MAGNETIC MATERIAL

[75] Inventor: Leslie V. Herriott, Wolverhampton, England

[73] Assignee: Lowe & Fletcher Limited, West Midlands, United Kingdom

[21] Appl. No.: 478,982

[22] Filed: Mar. 25, 1983

Related U.S. Application Data

[63] Continuation-in-part of Ser. No. 160,492, Jan. 11, 1979, abandoned.

[30] Foreign Application Priority Data

Feb. 18, 1978 [GB] United Kingdom ..... 656878

[51] Int. Cl.[4] ..... E05B 19/26

[52] U.S. Cl. ..... 70/413; 335/306

[58] Field of Search ..... 70/413, 276, 278; 76/110; 335/207, 306; 361/171, 172

[56] References Cited

U.S. PATENT DOCUMENTS

| | | | |
|---|---|---|---|
| 2,121,301 | 6/1938 | Ractliffe | 70/413 |
| 2,966,789 | 1/1961 | Hall | 70/276 |
| 3,393,541 | 7/1968 | Wake | 70/276 |
| 3,408,837 | 11/1968 | Felson | 70/276 |
| 3,421,348 | 1/1969 | Hallmann | 70/276 |
| 3,506,939 | 4/1970 | Hesser et al. | 70/413 X |
| 3,654,782 | 4/1972 | Heimann | 70/413 X |
| 3,753,183 | 8/1973 | Aspinwall et al. | 335/284 |
| 3,873,892 | 3/1975 | Dettling et al. | 70/413 X |
| 3,898,599 | 8/1975 | Reid et al. | 335/302 |
| 3,942,345 | 3/1976 | Sasahara | 70/276 |
| 3,969,644 | 7/1976 | Nowak | 335/306 X |
| 4,022,038 | 5/1977 | Miller | 70/276 |
| 4,073,166 | 2/1978 | Clark | 70/413 X |
| 4,333,327 | 6/1982 | Wake | 70/413 X |
| 4,416,127 | 11/1983 | Gomez-Olea Naveda | 70/413 X |
| 4,562,711 | 1/1986 | Fliege | 70/413 X |

FOREIGN PATENT DOCUMENTS

| | | | |
|---|---|---|---|
| 2330014 | 1/1975 | Fed. Rep. of Germany | 70/413 |
| 2653799 | 6/1977 | Fed. Rep. of Germany . | |
| 2706919 | 8/1978 | Fed. Rep. of Germany | 70/413 |
| 2717200 | 11/1978 | Fed. Rep. of Germany | 70/276 |
| 2948068 | 6/1981 | Fed. Rep. of Germany | 70/413 |
| 636858 | 1/1928 | France | 76/110 |
| 1427075 | 12/1966 | France . | |
| 1512239 | 2/1968 | France . | |
| 459368 | 9/1968 | Switzerland . | |
| 1588811 | 4/1981 | United Kingdom | 70/276 |
| 0918412 | 4/1982 | U.S.S.R. | 70/276 |

*Primary Examiner*—Lloyd A. Gall

*Attorney, Agent, or Firm*—Spencer & Frank

[57] ABSTRACT

A key comprising an elongated body made of magnetic material and having a handle at one end. A pair of like magnetic poles are located in the elongated body at positions which are spaced apart angularly around the longitudinal axis of the body but are not spaced apart along the axis.

8 Claims, 3 Drawing Sheets

KEY MADE OF MAGNETIC MATERIAL

TECHNICAL FIELD

This application is a continuation in part of application Ser. No. 160492 filed under the Patent Co-operation Treaty on Jan. 11th, 1979, now abandoned.

THE BACKGROUND ART

U.S. Pat. No. 3,566,637 of Hallman discloses various arrangements of magnetic lock and key. Each such lock has a number of permanently magnetized elements which must be moved by a magnetic field associated with the key into predetermined positions before the lock can be operated to drive an associated device. The first form of key mentioned in the Hallman patent consists of a flat, elongated piece of magnetic material which is magnetized to present at each major face of the piece of material a number of magnetic poles. For each such pole, there is a corresponding pole of unlike polarity occupying a corresponding position on an opposite major face of the piece of magnetic material. Thus, the piece of magnetic material behaves as an assembly of bar magnets with the respective poles of each bar magnet spaced apart in the same direction, that is the direction extending between the major faces of the piece of magnetic material. The Hallman patent also mentions that the key may be a strip of support material to which permanent magnets are attached.

A third form of key disclosed in the Hallman patent aforesaid is circular, that is the key has the form of a cylindrical pin. This key is stated to be formed with transversely extending magnets. FIG. 4*a* of the drawings of the Hallman patent shows an example in which two of these magnets present like poles which are adjacent to each other. This configuration can be achieved by insertion of pre-formed bar magnets into respective sockets in a key body but could not be achieved by magnetizing a single piece of magnetic material.

In each of the keys disclosed in the Hallman patent, it is inevitable that, for each magnetic pole on the key, there will be a corresponding pole of unlike magnetic polarity occupying a diametrically opposite position. This restricts the number of different patterns of magnetic poles which could be provided in mechanically similar keys and restricts the scope of application of the keys.

SUMMARY OF THE INVENTION

According to a first aspect of the present invention, there is provided a key comprising an elongated body of magnetic material having a longitudinal axis and a handle adjacent to one end of and connected with the body, wherein there are on the surface of the body a pair of like magnetic poles having respective positions which are spaced apart angularly around said axis but are not spaced apart along the axis.

The poles of said pair may occupy diammetrically opposite positions or may be spaced substantially less than 180° apart.

According to a second aspect of the invention, there is provided a key comprising an elongate body of magnetic material and a handle adjacent to one end of and connected with the body, wherein there are on the surface of the body at respective positions between the ends of the body a plurality of distinct magnetic poles and wherein one of said poles faces in a direction inclined at an angle substantially less than 180° and substantially more than 0° to the direction in which another of the poles faces.

The body may have a polygonal cross-section, the surface of the body which extends between the ends thereof comprising a number of flat faces. Alternatively, the surface of the body may be curved. In a case where the surface on which the poles are present is curved, references herein to the direction in which a pole faces are references to a direction which is perpendicular to a tangent to the surface at the center of the pole.

There is also provided a method of producing a key in accordance with the second aspect of the invention and comprising the steps of forming an elongate body of unmagnetized magnetic material having a longitudinal axis, establishing a predetermined positional relation between a magnetizing head and the body, energizing the magnetizing head to impress at least one localized magnetic pole on the body between ends thereof, adjusting the positional relation between the magnetizing head and the body at least angularly about said axis through an angle substantially greater than 0° and substantially less than 180° and energizing the magnetizing head again to impress at least one further localized magnetic pole on the body between the ends thereof at a position spaced angularly about said axis from said one pole.

A handle can be rigidly connected with the body prior to magnetizing of the body. From a stock of unmagnetized keys, there can be produced duplicates of a magnetized key by impressing upon the unmagnetized keys permanent magnetic poles.

The key preferably further comprises a sheath of non-magnetic material enclosing the body and assembled with the body prior to magnetizing of the body. The handle also may be of non-magnetic material.

BRIEF DESCRIPTION OF THE DRAWINGS

The invention will now be described by way of example, with reference to the accompanying drawing wherein.

DESCRIPTION OF THE PREFERRED EMBODIMENTS

Figure 1:
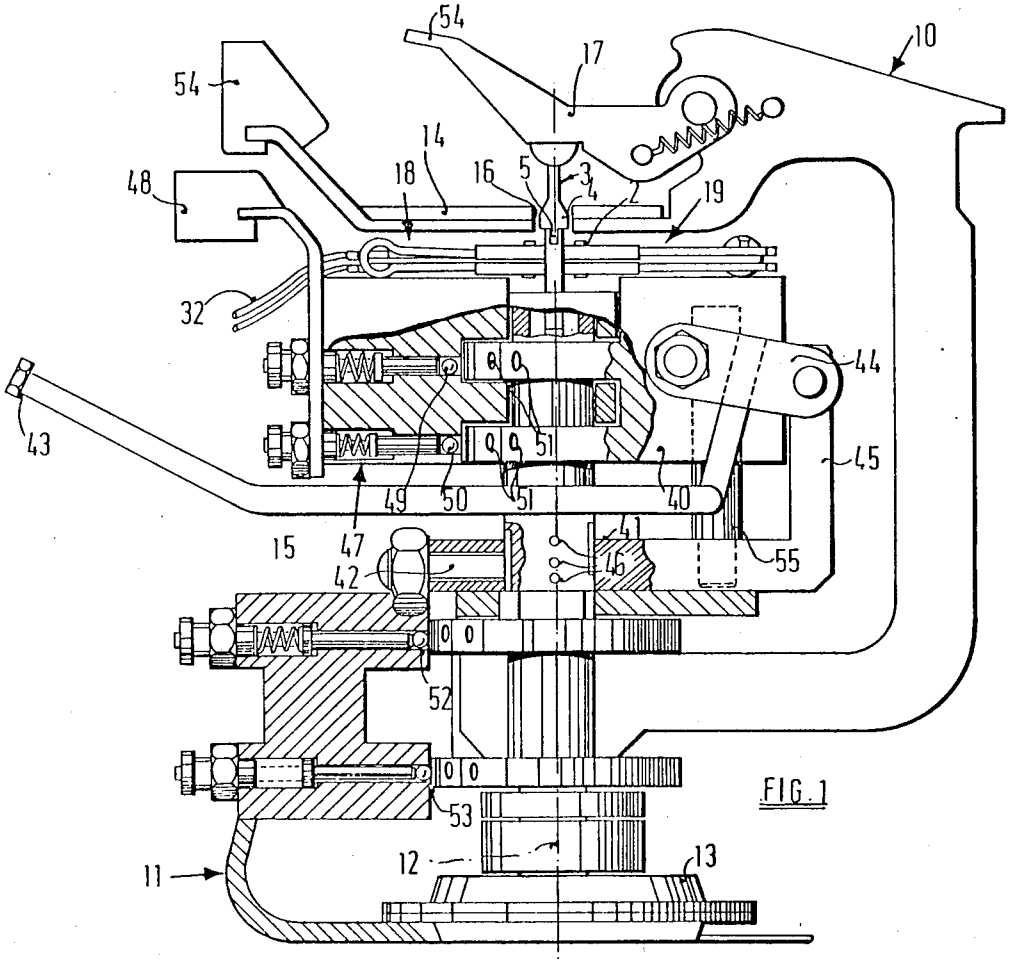
FIG. 1 shows diagrammatically a side elevation of apparatus for magnetizing the body of a key, certain parts being broken away.
Figure 2:
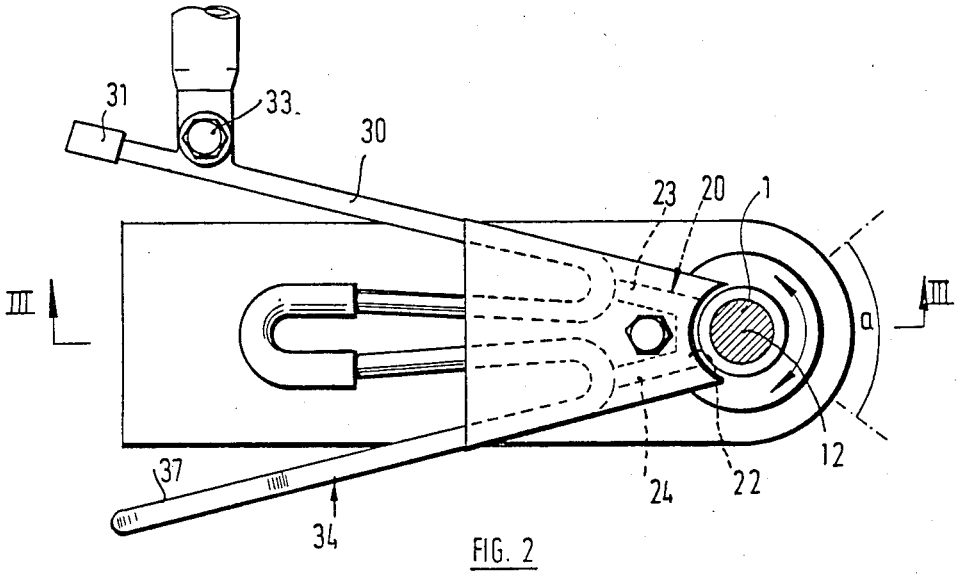
FIG. 2 shows on an enlarged scale a plan view of one magnetizing head of the apparatus shown in FIG. 1, together with an adjacent key body which is shown in cross section.
Figure 3:
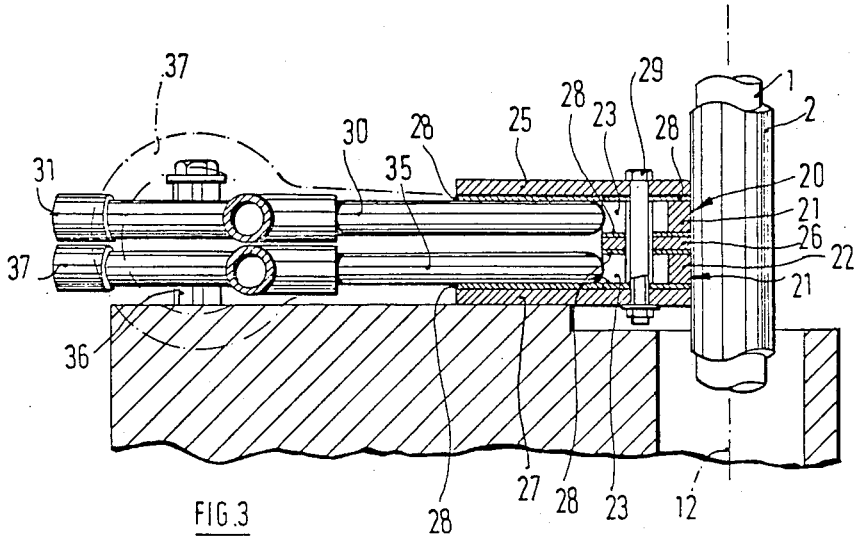
FIG. 3 is a side elevation of the parts shown in FIG. 2, certain of these parts being shown in cross section on the line III—III of FIG. 2.
Figure 4:
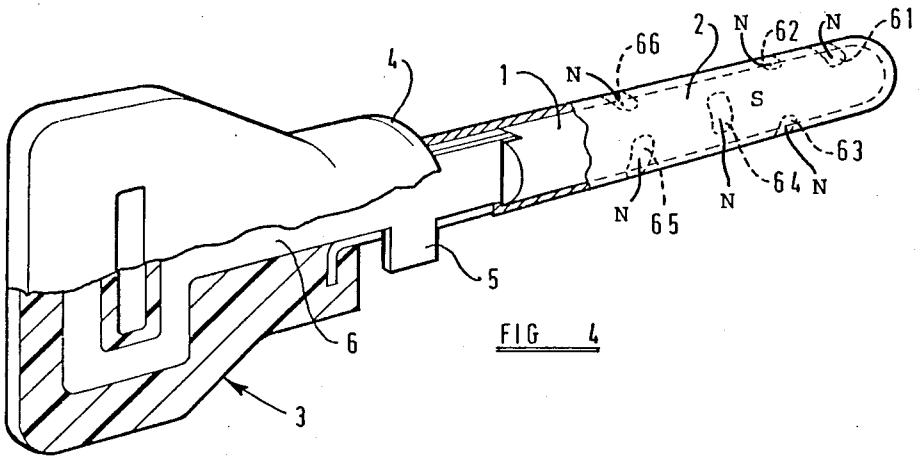
FIG. 4 shows a perspective view of the key with certain parts broken away.

The apparatus illustrated in FIGS. 1, 2 and 3 of the accompanying drawings is intended for use in magnetizing a magnetic body of a key which is illustrated in FIG. 4. The key comprises a cylindrical body 1 of magnetic material, for example a sintered isotropic ferrite. The body is enclosed by a sheath in the form of a sleeve 2 of non-magnetic material, for example stainless steel or brass. One end of the sleeve is closed and an opposite end of the sleeve is embedded in a handle portion 3 of the key. The handle portion is formed by molding plastic material around a core 6 of non-magnetic metal. One end portion of the core 6 engages in a diametral groove formed in an end face of the body 1. The core is formed with a laterally projecting lug 5 which extends through a slot formed in the sleeve 2 adjacent to the handle portion of the key. Adjacent to the lug 5 but spaced therefrom in a direction away from the closed end of the sleeve 2, the handle portion includes a boss 4 of plastic material. The key is produced by inserting the body 1, while in an unmagnetized condition, into the sleeve and then placing the core 6 and a free end portion of the sleeve in a mold cavity. Plastic material is then injected into the mold cavity to form the plastic portion of the key. The plastic material forces the body 1 against the closed end of the sleeve and fills the space in the sleeve around the core 6, so that the core, the sleeve and the body 1 are rigidly united with one another. Subsequently, the body 1 of the key is magnetized.

In the use of the key the lug 5 engages in a complementary formation in a lock to establish a predetermined angular relation between the key body 1 and a key-receiving member of the lock. The end face of the boss 4 cooperates with the lock to establish a predetermined axial position of the body 1 relative to the key-receiving member of the lock. Because permanent magnetic poles are impressed on the body 1 after the body has been rigidly connected with the lug 5 and the boss 4, the positions of the magnetic poles with respect to the lug and the boss can be controlled with a high degree of accuracy. Typically, the diameter of the body 1 is 4 mm and the thickness of the sleeve 2 is 0.1 mm. If the mechanical properties of the body of magnetic material are adequate, the sleeve may be omitted, the core 6 and the body 1 being modified to interfit in a more complex manner than shown in FIG. 4.

The magnetizing apparatus comprises a carrier 10 which is adapted to support the key for rotation relative to a base 11 of the apparatus about an axis 12 which coincides with a longitudinal axis of the key body 1. The carrier is connected with the base by a bearing 13 and includes a platform 14 which is spaced from the bearing along the axis 12 by a gap 15. In the platform 14, there is formed an aperture through which the key body 1 and sleeve 2 extend and, surrounding the aperture at the upper side of the platform, a recess for receiving the boss 4 and lug 5. The recess includes a portion complementary to the lug 5 to establish a predetermined angular relation between the carrier 10 and the key body 1. On the carrier there is mounted a spring-loaded presser member 17 which, when engaged with the handle portion 3 of a key as shown in FIG. 1, ensures that the boss 4 is properly seated in the recess 16. In this way, the position of the key body 1 along the axis 12 relative to the carrier 10 is accurately controlled.

For subjecting the key body 1 to magnetic flux, there are provided two magnetizing heads 18 and 19 which lie within the gap 15 and near to the axis 12 but spaced sufficiently far from the axis to permit the sleeve 2 of the key to extend between them.

Each magnetizing head comprises an upper electrical conductor 20 and a lower electrical conductor 21. Each of these electrical conductors has a substantially truncated V shape, having an arcuate limb 22 which lies near to the axis 12 and rectilinear limbs 23 and 24 which extend from opposite ends of the arcuate limb in directions away from the axis 12. The cross section of each of the limbs 22, 23 and 24 may be rectangular. The arcuate limb 22 present towards the axis 12 a concave arcuate surface which, when the apparatus is in use, lies close to or even in contact with the sleeve 2 of the key in order that the arcuate surface of the electrical conductor should be as close as possible to the magnetic body 1 of the key. The electrical conductors 20 and 21 are formed of a material having a high electrical conductivity, for example platinum or silver.

The radius of curvature of the arcuate surface of each of the electrical conductors 20 and 21 which is presented towards the axis 12 may be substantially equal to the external radius of the sleeve 2. Each electrical conductor is then positioned with its center of curvature lying on the axis 12 so that all parts of the arcuate surface lie at the same distance from the axis of the key body 1. If the radius of curvature of the arcuate surface differs substantially from that of the sleeve 2, then the center of the arcuate surface would lie closer to the axis 12 than other parts of the arcuate surface. The angle a subtended at the axis 12 by the arcuate surface of each of the electrical conductors 20 and 21 is preferably at least 10°. More preferably this angle is approximately 60°. It will be noted that the dimension of each limb 22 which extends parallel to the axis 12 is smaller than the dimension of each limb 22 which extends around the axis 12. Thus, each arcuate surface presented by the electrical conductors 20 and 21 towards the axis 12 is elongate and its longitudinal centerline lies substantially in a plane perpendicular to the axis 12.

Each of the magnetizing heads 18 and 19 fuerther comprises upper, middle and lower magnetic conductors 25,26 and 27 which are formed of a material having a low resistance to magnetic flux, for example mild steel. The upper and middle magnetic conductors are spaced apart by a gap in which the upper electrical cnductor 20 lies. The middle and lower magnetic conductors are spaced apart by a further gap in which the lower electrical conductor 21 lies. The electrical conductors 20 and 21 are insulated electrically from the magnetic conductors 25,26 and 27 by layers 28 of electrically insulating material. The middle magnetic conductor 26 is in the form of a flat plate having a profile corresponding to that of the electrical conductors 20 and 21, that is the magnetic conductor has an arcuate edge lying directly between the arcuate surfaces of the electrical conductors which face towards the axis 12, rectilinear edges extending radially with respect to the axis 12 and lying between the corresponding surfaces of the electrical conductors and a further rectilinear edge spaced further from the axis 12 than is the arcuate edge and coinciding with a tangent to a circle drawn around the axis 12. The upper and lower magnetic conductors 25 and 27 have a shape similar to that of the middle conductor 26 but with the addition of flanges along the radially extending edges. The flanges of the upper magnetic conductor just touch the flanges of the lower magnetic conductor. An aperture is formed centrally in each of the magnetic conductors and in each layer of electrical insulation adjacent to the magnetic conductors. The assembly of electrical conductors, magnetic conductors and layers of electrical insulation are held together by a bolt 29 which extends through these apertures and is insulated electrically from both of the electrical conductors and from the magnetic conductor 26 by a sleeve of insulating material fitted around a shank of the bolt.

Means is provided for conducting an electric current to the electrical conductors 20 and 21 of each magnetizing head and also for conducting a fluid coolant to the electrical conductors. This means comprises a series of metal and non-metal tubes connected end-to-end to provide a coolant duct through which a fluid coolant can be conveyed. Water is a suitable coolant and the apparatus may include a pump (not shown) for pumping water from a reservoir through the coolant duct.

The non-metal tubes of the coolant duct are electrically insulating. The metal tubes of the coolant duct are formed of copper or another good electrical conductor. The coolant duct comprises a metal tube 30 having on one end a union 31 by which the tube is connected with a flexible conduit 32. Adjacent to the union 31, there is provided on the tube 30 an electrical terminal 33. The tube 30 extends from the terminal 33 to the limb 23 of the upper electrical conductor 20 with which the tube is united by fusion. An end of the tube 30 remote from the union 31 is connected by a non-metal tube with an end of a metal tube 34 which is united by fusion with the limb 24 of the upper electrical conductor 20. The tube 34 extends away from the electrical conductor 20, around a bend 37 in a vertical plane and returns to the limb 24 of the lower electrical conductor 21, with which limb the tube is united by fusion. A lower end of the tube 34 is connected by a non-metal tube with a lower metal tube 35 similar to the tube 30. The tube 35 is united by fusion with the limb 23 of the lower electrical conductor 21 and has an electrical terminal 36 and a union 37. The terminals 33 and 36 are connected by means of flexible electric conductors (not shown) to a power pack (also not shown) capable of causing a large current pulse to flow through the circuit comprising the tube 30, the upper electrical conductor 20, the tube 34, the lower electrical conductor 21 and the tube 35. It will be noted tha a current which flows in one direction through the upper electrical conductor flows in the opposite direction through the lower electrical conductor.

As shown in FIG. 1, the magnetizing heads 18 and 19 lie at the same position along the axis 12. These heads can be moved along the axis relative to the carrier 10 and the body 1 of the key. Furthermore, the head 18 can move about the axis 12 relative to the head 19 so that the angular relation between each head and the body 1 of the key can be adjusted independently. The assembly of magnetic and electrical conductors and the tubes which are comprised by the head 19 are supported on a support 40 which is constrained by a fixed pillar 55 against movement around the axis 12 but is adjustable along the axis. The support 40 is rotatable around a tube 41 which extends upwardly from the bearing 13 towards the platform 14. This tube is maintained by the bearing in coaxial relation with the body 1 of the key and is constrained against rotation about the axis 12 by a pin 42 engaging in a vertical slot formed in the tube.

The assembly of magnetic and electrical conductors and the coolant duct of the magnetizing head 18 are supported on a support 47 which is mounted on the tube 41 for rotation relative thereto about the axis 12 and interfits with the support 40 in such a manner that the supports 40 and 47 move together along the axis. The tube 41 is constrained to move along the axis with the supports. For raising and lowering the tube 41 and supports 40 and 47, there is provided a handle 43 which is rigidly secured to a lever 44. One end of the lever is pivotally connected with the support 40 and the other end of the lever is pivotally connected with a post 45 which is rigid with the base 11.

Means is provided for establishing alternative positions of the support 40 along the axis 12. This means comprises two vertical rows of apertures or recesses 46 formed in the tube 41 at diametrically opposite positions between the bearing 13 and the support 40. On the base 11 there are provided detents (not shown) for engaging releasably in the apertures or recesses 46. Each such detent preferably comprises a ball which is urged towards the tube 41 by a spring-loaded piston. In the particular example illustrated, there are five apertures or recesses 46 defining five alternative positions of the support 40 along the axis 12. In one extreme position, the magnetizing head 19 is adjacent to the underside of the platform 14 and to a part of the body 1 of the key near to the lug 5. In the other extreme position, the head 19 is adjacent to an end portion of the body 1 remote from the lug 5.

For turning the support 47 about the axis 12 there is provided a handle 48. Alternative positions of the support about the axis are defined by detents 49 and 50 engageable in selected ones of recesses 51 formed in the support 40. These detents are urged towards the support 40 and when a detent is aligned with one of the recesses 50, that detent engages partly in the support 40 and partly in the support 47.

A further pair of detents 52 and 53 are provided on the base 11 to define alternative positions of the carrier 10 about the axis 12. The detents 49,50,52,53 and the detents associated with the apertures 46 are all arranged in a similar manner which is illustrated in FIG. 1.

When the body 1 of a key is to be magnetized, the presser member 17 is raised away from the platform 14 and the key is inserted into the carrier 10 with the body 1 and sleeve 2 of the key extending between the magnetizing heads 18 and 19 and the boss 4 of the key seated in the recess 16 of the carrier. By means of the handle 43, the magnetizing heads 18 and 19 are moved to their uppermost positions and are then retained in that position by engagement of a detent in one of the apertures or recesses 46. By means of a handle 54 the carrier 10 is turned about the axis 12 to establish the required angular relationship between the body 1 of the key and the magnetizing head 19. By means of the handle 48, the magnetizing head 18 is moved about the axis to establish the required angular relationship with the head 19. These angular positions are maintained by engagement of one of the detents 49 and 50 in an associated recess and one of the detents 52 and 53 in an associated recess. A pulse of electric current is passed through the electrical conductors of the magnetizing heads. The conductors of the head 18 may be connected in series with the conductors of the head 19, in which case a single pulse is passed through the conductors of both heads and the heads are energized concurrently. Alternatively, a current pulse may be passed through the conductors 20 and 21 of the head 18 and then a further current pulse passed through the electrical conductors of the head 19 to energize the heads successively.

The flow of electric current through the conductors 20 and 21 of the head 18 establishes a magnetic flux which imprints magnetic poles on the body 1 of the key. Like poles are established adjacent to the upper and lower magnetic conductors 25 and 27 while adjacent to the middle magnetic conductor 26 there is established an opposite magnetic pole. The head 19 imprints on the body of the key a substantially identical pattern of magnetic poles, the pole adjacent to the middle magnetic conductor of the head 19, being like the pole adjacent to the middle magnetic conductor of the head 18. Since the magnetic conductors provide paths of low resistance for the magnetic flux, the magnetic poles do not extend significantly above the upper magnetic conductor or below the lower magnetic conductor.

After each of the magnetizing heads 18 and 19 has been energized, the carrier 10 and support 47 may be turned about the axis 12 to establish a new angular relationship between the magnetizing heads and the body 1 of the key. The magnetizing heads may then be energized once more to imprint on the body 1 further magnetic poles at the same position along the axis of the key but spaced angularly about that axis from the previously imprinted poles by angles which are substantially less than 180°. The magnetizing heads 18 and 19 may then be moved along the axis 12 relative to the key body 1 by means of the handle 43 to a second axial position, further required angular relations between the magnetizing heads and key body established and the magnetizing heads then energized once more. In the second axial position of the magnetizing head 18, the upper magnetic conductor 25 may occupy the same position along the axis 12 as is occupied by the lower magnetic conductor 27 in the first axial position.

Each magnetic pole imprinted on the body 10 of the key extends somewhat further around the axis of the key then do the arcuate surfaces of the electrical conductors 20 and 21, depending upon the extent to which leakage of magnetic flux occurs in regions ajdacent to the rectilinear edges of the magnetic conductors. Thus, in a case where the electrical and magnetic conductors subtend at the axis of the key an angle of approximately 60°, the magnetic poles imprinted on the key may subtend at the axis of the key an angle of approximately 90°. The angular extent of the mangetic poles and the flux density at different positions within those poles can be varied by varying the leakage of magnetic flux from the magnetizing head. The leakage of magnetic flux can be increased by partly or entirely omitting the flanges of the upper and lower magnetic conductors 25 and 27.

While we prefer to employ two magnetizing heads, it would be within the scope of the invention to provide in the apparatus a single magnetizing head. This could be energized in four alternative positions around the axis of the key to imprint on the body of the key four poles at the same position along the key axis.

The arrangement of two electrical conductors and three magnetic conductors shown in FIG. 3 and used in the manner hereinbefore described is convenient, in that successive poles along the length of the key which correspond to the middle magnetic conductor 26 do not interfere with each other. Such interference is avoided by the presence of opposite poles between successive poles corresponding to the middle magnetic conductor. When poles are impressed at different positions along the body of the key, the first poles corresponding to the upper and lower magnetic conductors of each magnetizing head are disturbed by subsequently impressed poles corresponding to the upper and lower magnetic conductors and there is established a single region having a magnetic polarity unlike that of the poles corresponding to the middle magnetic conductors, this region extending between positions occupied by the magnetizing heads and extending around each distinct pole which corresponds to a middle magnetic conductor. There results a number of distinct poles of like polarity surrounded by a single region of opposite magnetic polarity.

The key illustrated in FIG. 4 has a number of distinct poles represented by broken lines and indicated by the reference numerals 61 to 66. These poles have the same magnetic polarity and there are further distinct poles of the same polarity concealed from view in FIG. 4. All of these poles are surrounded by a single region of opposite polarity which extends from one end of the key body to the other. It will be seen that each of the poles 61 to 66 faces in a direction different from the direction in which the other poles face. Thus, the poles 62 and 63 face in opposite directions whereas the pole 61 faces in a direction which differs by approximately 30° from the direction in which the pole 62 faces. It will be understood that, where there are diametrically opposite poles, these are of like polarity. There are no pairs of unlike, localized, distinct poles occupying diametrically opposite positions.

The poles 66 and 65 are spaced apart angularly about a longitudinal axis of the key body 1 but are not spaced apart along that axis. They are spaced along the axis from each of the other poles shown in FIG. 4.

Figure 5:
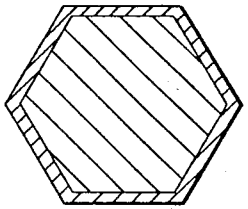
FIG. 5 shows a transverse cross-section through a part of a modified key.

The key shown in FIG. 4 may be modified to have a body of magnetic material which has a polygonal transverse cross-section, for example a hexagonal cross-section, as shown in FIG. 5. The cross-sectional shape of the sheath also would be modified to complement that of the body of magnetic material.

In the modified key illustrated in FIG. 5, each distinct magnetic pole would be on one of the flat surfaces of the key which together make up the external surface of the sheath. These poles would face in respective directions which differ from each other by 60°, 120° and 180°. Again, all of the distinct poles would have a like polarity.

Although the key disclosed herein is intended primarily for use in a lock having magnetic elements which can be moved by the magnetic field of the key, the key may also be used in other devices adapted to recognize a particular pattern of magnetic poles, for example by means of correspondingly positioned Hall effect devices.

I claim:

1. A key comprising an elongated body of magnetic material defining an axis and a handle adjacent to one end of and connected with the body wherein there is on a surface of the body a plurality of distinct magnetic poles, two of said poles are spaced along the axis from a third of said poles, said two poles are spaced from each other angularly about said axis but are not spaced from each other along the axis and wherein all of said distinct magnetic poles have like magnetic polarity and a region of unlike magnetic polarity extends around the entirety of all of the distinct poles.

2. A key according to claim 1 wherein each of said distinct magnetic poles subtends at the axis of said body an angle of approximately 90°.

3. A key according to claim 1 further comprising a sheath of non-magnetic material covering said body, wherein the sheath has a closed end and wherein an opposite end portion of the sheath is united with the handle.

4. A key according to claim 1 which has a lug projecting relative to said body in a direction transverse to the length of said body for cooperation with a lock when the key is used to establish a predetermined positional relation between the key and a formation of the lock.

5. A key according to claim 1 wherein said handle is formed of a plastics material molded onto the body.

6. A key comprising an elongated body of magnetic material having a longitudinal axis and a handle adjacent to one end of and connected with the body, wherein there is on a surface of the body a pair of like magnetic poles having respective positions which are spaced apart angularly around said axis but are not spaced apart along the axis, wherein said poles face in respective directions which are inclined to each other at an angle substantially less than 180° and substantially greater than 0° and wherein all of the magnetic poles on said surface of the body have like magnetic polarity and each of said poles is entirely surrounded by an area of opposite magnetic polarity which is common to all of the poles.

7. A key according to claim 6 wherein said body has six sides extending longitudinally of the body and each of said magnetic poles lies on a respective one of said sides and between the ends of the body.

8. A key according to claim 6 wherein said body has six sides extending longitudinally of the body, each of said magnetic poles lies on a respective one of said sides and wherein at least one of said poles is spaced from the ends of the body.

* * * * *